United States Patent [19]

Brubaker

[11] 4,235,192

[45] Nov. 25, 1980

[54] CORNER PAINTING SHIELD

[76] Inventor: Thomas G. Brubaker, 307 N. Lee St., Falls Church, Va. 22046

[21] Appl. No.: 103,044

[22] Filed: Dec. 13, 1979

[51] Int. Cl.[3] ..... B05C 11/00

[52] U.S. Cl. ..... 118/504

[58] Field of Search ..... 118/504, 505; 427/272, 427/282; 15/257 R; 51/262 R, 262.1, 274, 310

[56] References Cited

U.S. PATENT DOCUMENTS

| | | | |
|---|---|---|---|
| 804,569 | 11/1905 | Watson | 118/504 |
| 1,386,706 | 8/1921 | Hall | 118/504 |
| 2,484,607 | 10/1949 | Cherem | 118/504 |
| 2,517,220 | 8/1950 | Lister | 118/504 |
| 2,538,743 | 1/1951 | Alston | 118/504 |
| 2,893,042 | 7/1959 | Paskaly | 118/504 X |
| 3,565,038 | 2/1971 | Barriger | 118/504 |
| 3,863,601 | 2/1975 | Eckart, Jr. | 118/504 |

FOREIGN PATENT DOCUMENTS

| | | | |
|---|---|---|---|
| 5156 | 3/1910 | United Kingdom | 118/504 |

*Primary Examiner*—Morris Kaplan

[57] ABSTRACT

A paint shield, formed of a relatively rigid resilient material, is substantially pentagon-shaped and has a handle portion opposite the vertex of two adjoining sides and is folded to about 140° on a line from the center of the handle to said vertex. When painting in a corner, the shield is placed on a generally planar surface with the vertex in said corner whereupon application of pressure, the fold angle and the planar angle formed by said sides expand until the side edges engage the corner structure to effect the shielding function.

1 Claim, 7 Drawing Figures

FIG.1
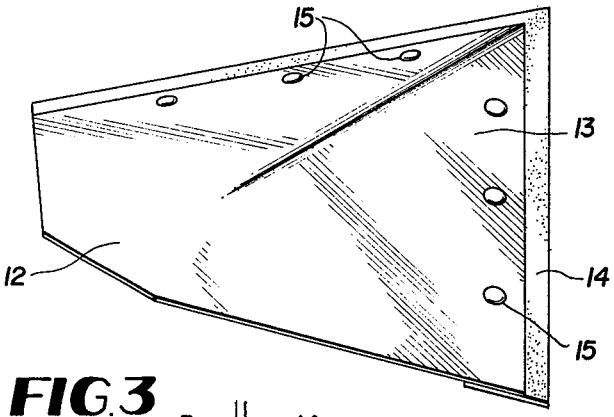
FIG.2
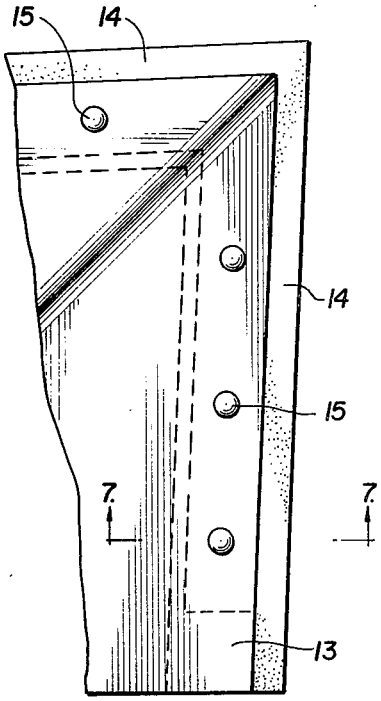
FIG.3
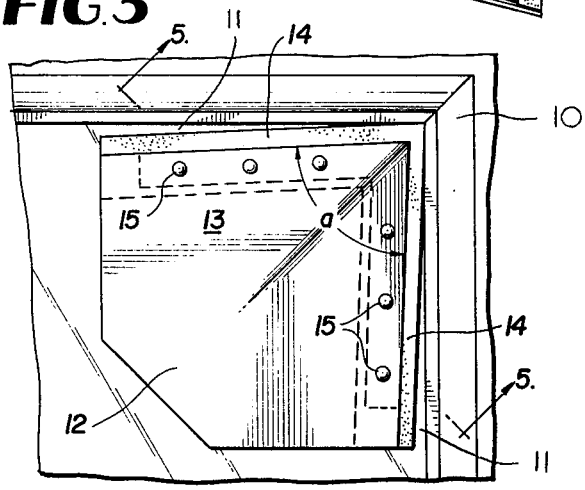
FIG.4
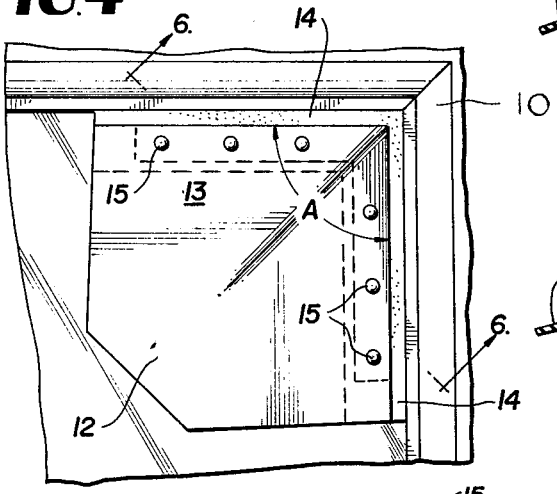
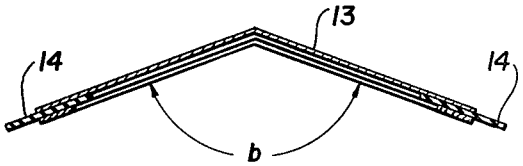
FIG.5
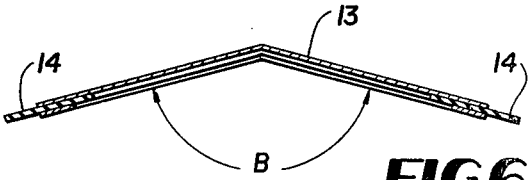
FIG.6
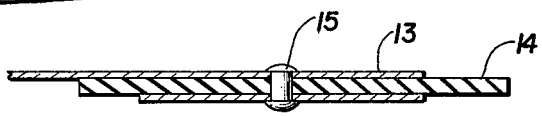
FIG.7

CORNER PAINTING SHIELD

The present device relates generally to window painting tools and specifically to a device which permits the painting of the corners of the sash and mullions of windows without getting paint on the glass portions of the window.

The principle object of the invention is to provide a tool which may be handily applied to the corner portions of glass surfaces of different sizes, thus aiding in the painting of the corner portions of mullion or sash.

Another object is to provide a corner shield which is durable and efficient.

These and other objects and advantages of the present invention will be apparent from the following description when considered in connection with the annexed drawings in which like numerals indicate like parts throughout the several views and in which:

FIG. 1 is a side perspective view of the invention,

FIG. 2 is a fragmentary plan view of the device showing the gasket edges and a portion of the body of the tool, FIG. 3 is a plan view of the device in position ready for use, FIG. 4 is a plan view of the device in use, FIG. 5 is a section on line 5—5 of FIG. 3, FIG. 6 is a section on line 6—6 of FIG. 4 and FIG. 7 is a section on line 7—7 of FIG. 2.

Referring now in more detail to the drawings, a window sash is indicated at 10 in FIGS. 3 and 4 leaving a space 11 in FIG. 3 between the sash and the device before pressure is applied to handle portion 12 which is machined to be held comfortably in the hand. The tool body 13 in FIGS. 1–7 being substantially pentagon-shaped and having a substantially V shaped cross section, FIGS. 5 and 6, and is to consist of relatively rigid material such as plastic or sheet metal giving the tool body its shape and a resilient quality so that when pressure is applied to the handle portion of the device angles a and b of FIGS. 3 and 5 respectivelly expand and change substantially to angles A and B of FIGS. 4 and 6 respectively. A gasket 14 is seen in FIGS. 1–7 to consist of a relatively soft strip of rubber or other resilient material secured to the tool body by rivets 15 or other suitable means as seen in FIG. 7.

While preferred embodiments are shown and described, it is contemplated that other embodiments may be practiced within the scope and spirit of the invention as set forth in the appended claim.

While the device has been shown and the structure described in detail, it is obvious that this invention is not to be considered as being limited to the exact form disclosed, and that changes in detail and construction may be made therein within the scope of what is claimed, without departing from the spirit of this invention.

Having thus set forth and disclosed the nature of this invention, what is claimed is:

1. A corner painting shield the body of which is made of a relatively rigid resilient material substantially pentagon-shaped with a handle portion opposite the vertex of two adjoining sides the edges of which have resilient strips affixed thereto said painting shield body being folded to substantially 140° on a line from the center of said handle portion to said vertex whereby when the shield is positioned on a generally planar surface with the vertex in a said corner and adequate pressure is applied at the handle portion, said fold angle and the planar angle formed by said sides expand until said resilient strips continuously engage the corner structure to effect the shielding function.

* * * * *